US006332814B2

(12) United States Patent
Sato et al.

(10) Patent No.: US 6,332,814 B2
(45) Date of Patent: Dec. 25, 2001

(54) CRIMP CONNECTOR WITH UNIFORM BENDING DIE

(75) Inventors: Kei Sato; Toshiaki Ozawa, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/796,589

(22) Filed: Mar. 2, 2001

(30) Foreign Application Priority Data

Mar. 3, 2000 (JP) ..... 12-059162

(51) Int. Cl.[7] ..... H01R 13/415
(52) U.S. Cl. ..... 439/741; 439/870
(58) Field of Search ..... 439/741, 870

(56) References Cited

U.S. PATENT DOCUMENTS 5,314,358 * 5/1994 Klemmer et al. ..... 439/741
5,458,426 * 10/1995 Ito ..... 439/741
5,711,067 * 1/1998 Jenner et al. ..... 439/741

FOREIGN PATENT DOCUMENTS 7-29748 6/1995 (JP) .

* cited by examiner

*Primary Examiner*—Tho D. Ta
(74) *Attorney, Agent, or Firm*—Finnegan, Henderson, Farabow, Garrett & Dunner, L.L.P.

(57) ABSTRACT

The present invention aims to provide a crimp connector wherein a crimp contact inserted in a connector housing 11 can surely be fixed to the proper position and thereby contact reliability can be enhanced in the case of being connected with a coupling connector. According to the crimp connector 10 of the present invention, since a protrusion 14 formed on the crimp contact 13 is bent after having inserted the crimp contact into a contact slot 12, the crimp contact can be surely fixed to the proper position. Therefore, not only can contact reliability be enhanced in the case of being connected with a coupling connector, but also a misoperation can be excluded during crimp-connecting an electric wire W with a crimp punch. Moreover, since a receiving stand which is an integral part of a connector housing can be utilized during bending a protrusion, a shape of the bent protrusion may be uniform, holding force of the crimp contact may be increased, and any chance of a fracture by unusual deformation can be eliminated.

4 Claims, 6 Drawing Sheets

CRIMP CONNECTOR WITH UNIFORM BENDING DIE

BACKGROUND OF THE INVENTION

The present invention relates to a crimp connector wherein a crimp contact is inserted forwards into a contact slot from the backside thereof.

FIG. 1 is a sectional view of a conventional crimp connector disclosed in Japanese Utility Model Provisional Publication No. 29748/95. The connector has such a structure that an electric wire is first crimp-connected onto a crimp contact 3 inserted in a connector housing 1 and then the crimp contact is set in an outer housing 4. In this conventional crimp connector, in order to join the crimp contact 3 on to the connector housing 1 without being drawn out, adopted is such a means that a flexible lance 5 is disposed on a wall defining a contact slot 2 and the crimp contact 3 is fixed in order not to be drawn out backward by means of linking the lance 5 to a recess 6 of the crimp contact 3 making use of deflectional deformation of the lance.

However, in the case of joining the crimp contact 3 without being drawn out with the flexible lance 5, due to the necessity of a deflection space/clearance space for the lance 5, an unfavorable clearance is liable to occur and a large clearance may make the crimp contact 3 movable back and forth resulting in degradation of contact reliability of a contact portion connected with a coupling connector. Further, as shown in FIG. 2, when an electric wire is crimped with a crimp punch 7, because of misalignment between a channel portion 8 of the crimp punch 7 and a crimp blade 9 of the crimp contact 3, the crimp punch 7 is likely to interfere unsuitably with the crimp blade 9 resulting in a crimp failure.

SUMMARY OF THE INVENTION

According to the crimp connector of the present invention, since a protrusion formed on the crimp contact is bent after having inserted the crimp contact into a contact slot, the crimp contact can be surely fixed to the proper position. Therefore, not only can contact reliability be enhanced in the case of being connected with a coupling connector, but also a misoperation can be excluded during crimp-connecting an electric wire with a crimp punch. Moreover, since a receiving stand which is an integral part of a connector housing can be utilized during bending a protrusion, a shape of the bent protrusion may be uniform, holding force of the crimp contact may be increased, and any chance of a fracture by unusual deformation can be eliminated.

BRIEF DESCRIPTION OF THE DRAWINGS

FIG. 8 are structural diagrams showing the situation before bending the protrusion of a crimp contact in the crimp connector.

FIG. 9 are structural diagrams showing the situation after bending the-protrusion of the crimp contact in the crimp connector.

DESCRIPTION OF THE PREFERRED EMBODIMENT

Figure 1:
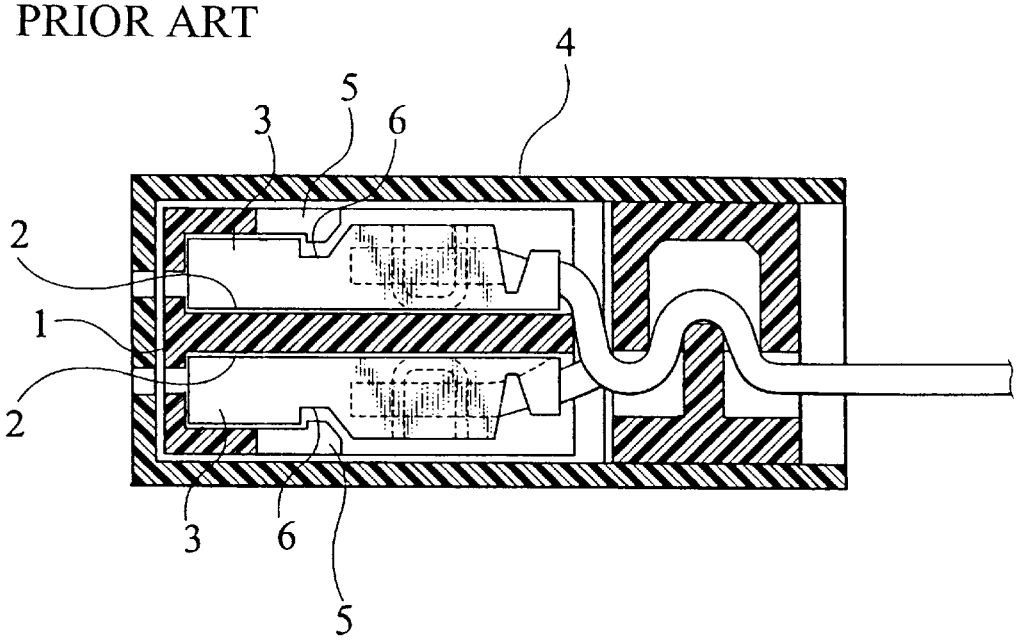
FIG.1 PRIOR ART
FIG. 1 is a sectional side view of a conventional crimp connector.
Figure 2:
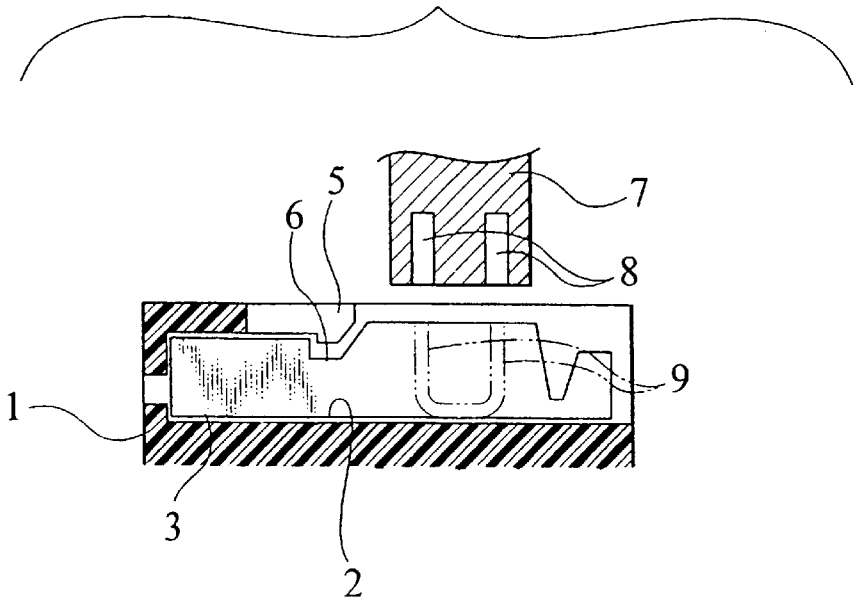
FIG.2 PRIOR ART
FIG. 2 is a sectional view showing the relationship between a crimp blade and crimp punch in the conventional crimp connector.
Figure 3:
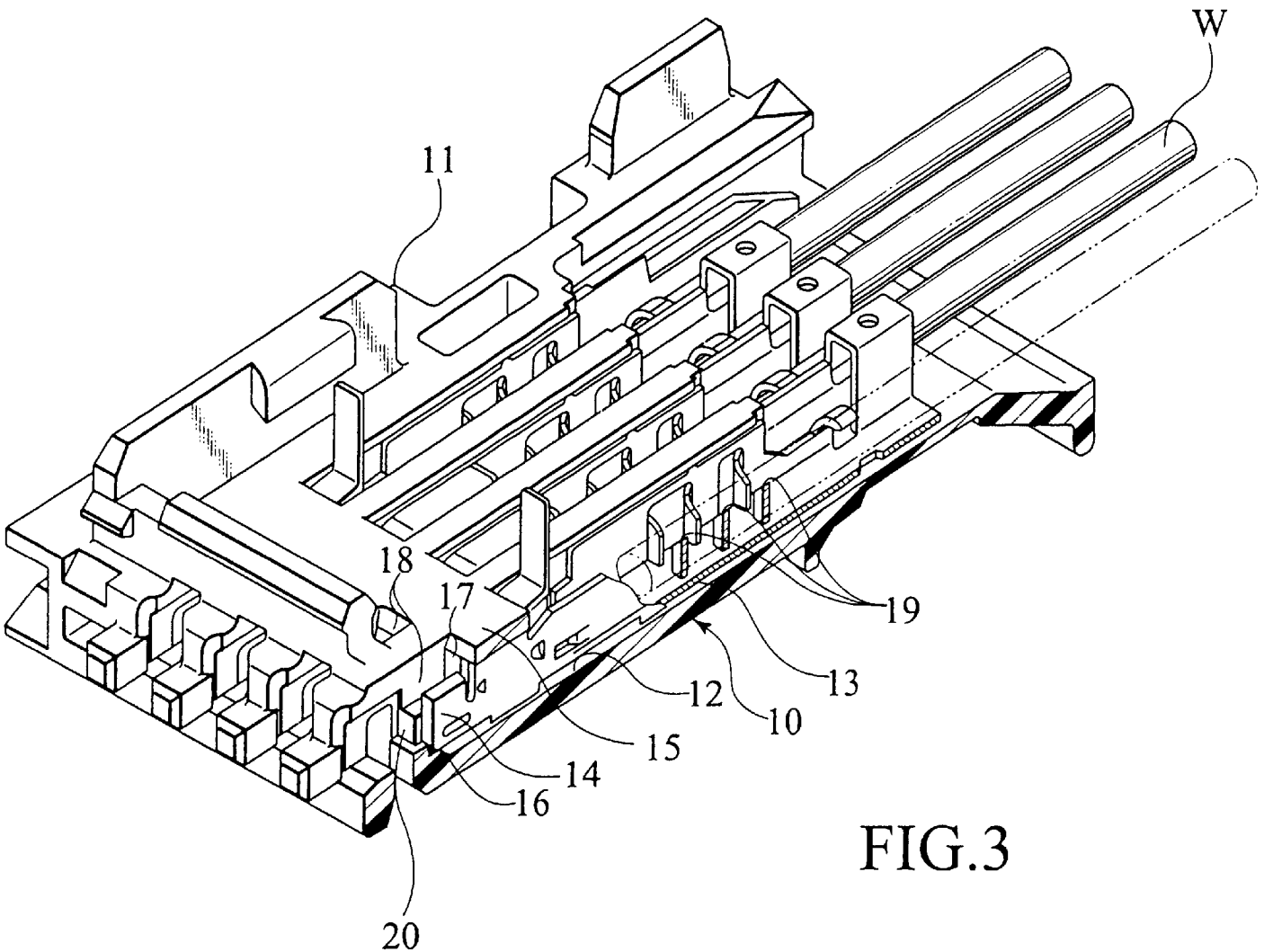
FIG. 3 is a diagram illustrating a crimp connector according to an embodiment of the present invention, and also a partially sectioned perspective view showing features before bending a protrusion.
Figure 4:
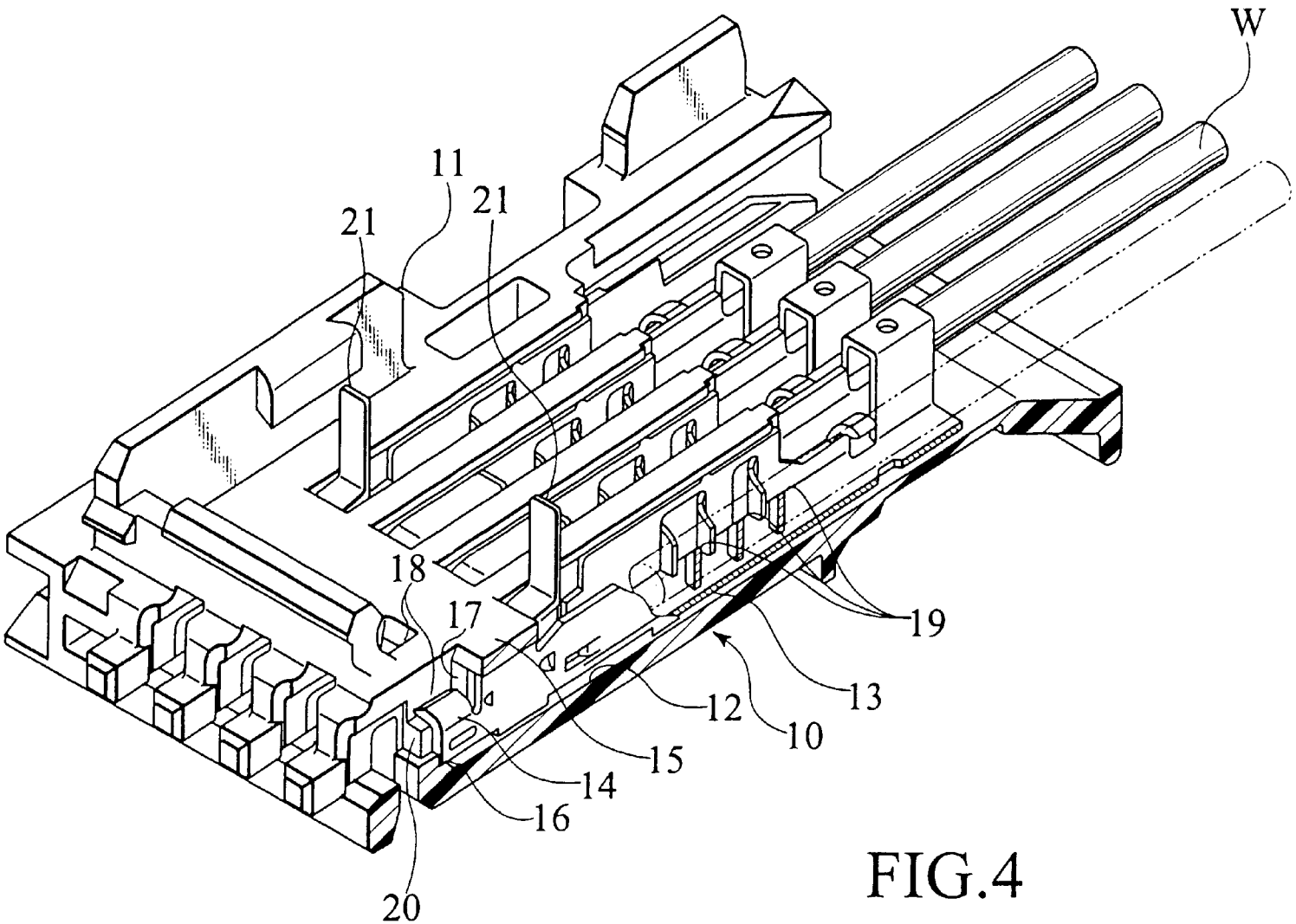
FIG. 4 is a diagram illustrating the crimp connector according to the embodiment of the present invention, and also a partially sectioned perspective view showing the features after bending the protrusion.
Figure 5:
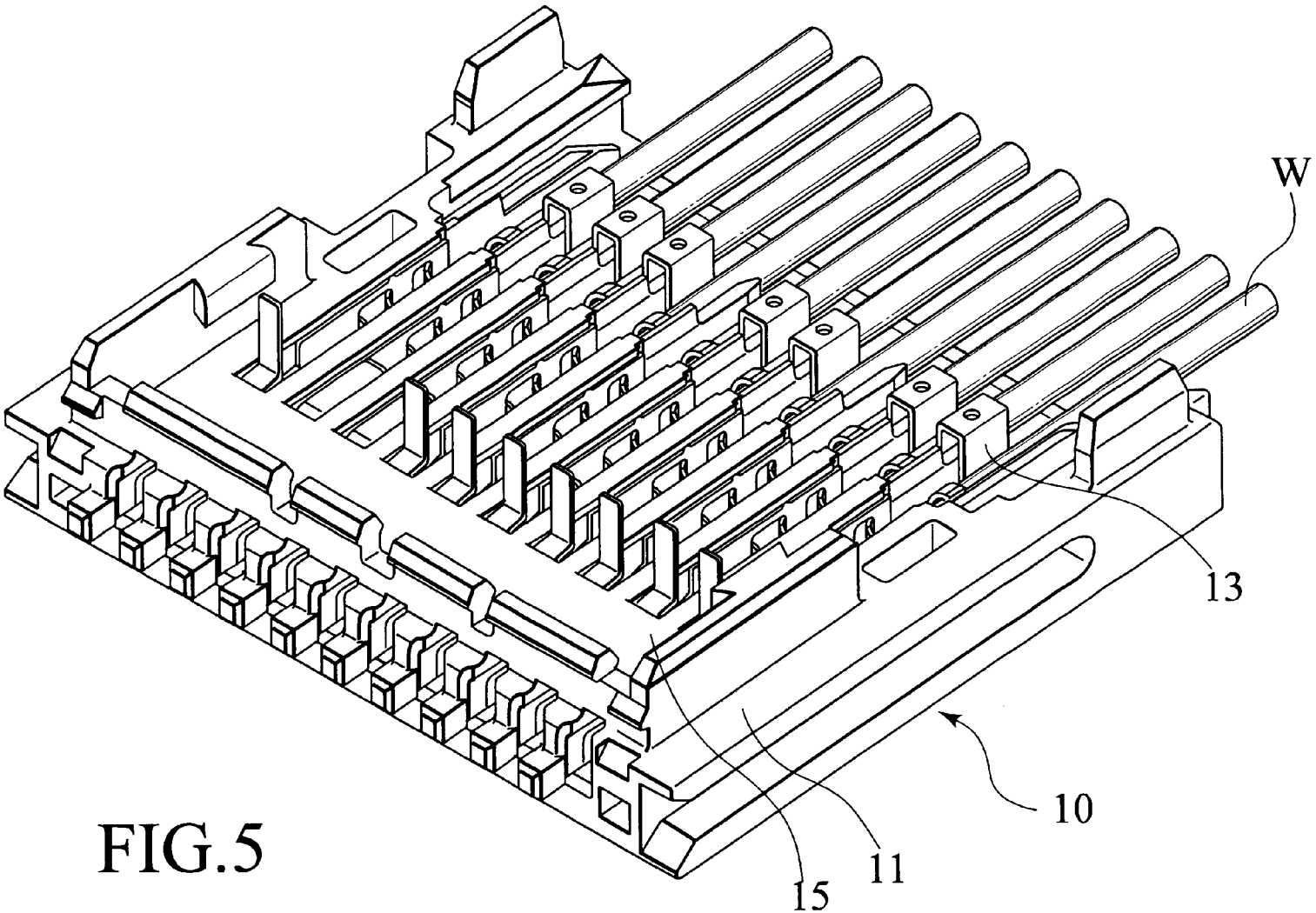
FIG. 5 is a perspective view showing a configuration of the crimp connector according to the embodiment of the present invention.

FIG. 3 is a diagram illustrating a crimp connector according to an embodiment of the present invention, and also a partially sectioned perspective view showing features before bending a protrusion, and FIG. 4 is a partially sectioned perspective view showing the features after bending the protrusion, and FIG. 5 is a perspective view showing a configuration of the crimp connector. The crimp connectors 10 may compose a joint connector by stacking plurality of them one on another, and crimp contacts 13 are fixed therein after being inserted from the backsides to the front sides into contact slots 12 of connector housings 11 with almost open tops.

A contact draw-out constraint wall 17 facing forwards and a front end wall 16 facing backward are both disposed in the contact slot 12 of the connector housing 11. A top of the contact slot 12 is covered with an upper wall 15 only at the front portion. The contact draw-out constraint wall 17 and the front end wall 16 are spaced from each other at a prescribed distance, and a receiving stand 20 with a rectangular cross section is formed as an integral part of the connector housing within a space in front of the contact draw-out constraint wall 17. A press window 18 is opened on the upper wall 15 at the position corresponding to the receiving stand 20.

The crimp contact 13 inserted in the contact slot 12 has about its front portion a connecting segment 21 which will be inserted in and joined to a terminal of the connector stacked and united onto the connector 10 concerned, and also has about its rear portion a crimp blade 19 onto which an electric wire will be crimped down. The crimp contact 13 has, at its front end, a protrusion 14 extending upward.

Figure 8A:
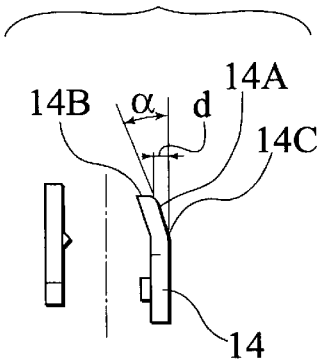
FIG. 8A is a front view.
Figure 8B:
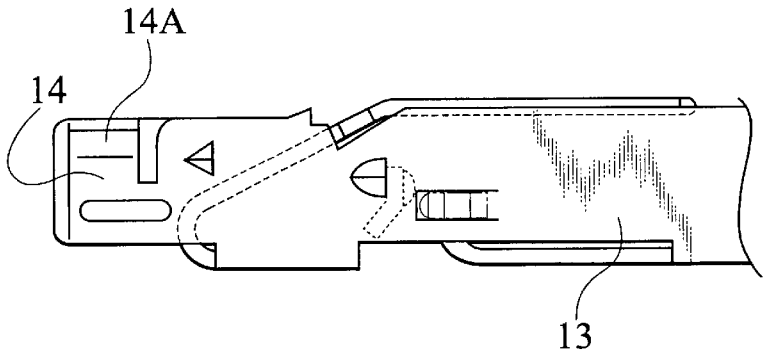
FIG. 8B is a side view.
Figure 9A:
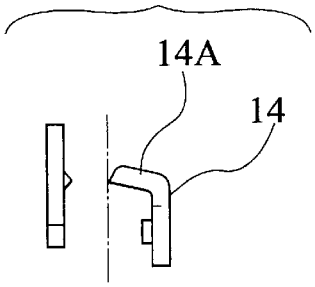
FIG. 9A is a front view.
Figure 9B:
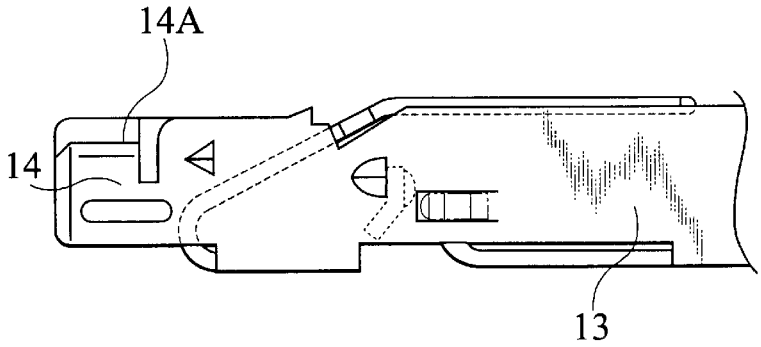
FIG. 9B is a side view.

The protrusion 14, as shown in FIG. 3, passes along the side of the contact draw-out constraint wall 17 when the crimp contact 13 is inserted into the contact slot 12, and after having passed, as shown in FIG. 4, FIG. 6, FIG. 7, and FIG. 9, the protrusion is bent by a bending jig 50 within the space in front of the contact draw-out constraint wall 17, resulting in the linkage with the contact draw-out constraint wall 17 so as to stop the backward draw-out of the crimp contact 13. Since the end portion 14A of the protrusion 14 is, as shown in FIG. 8A, inclined at a prescribed angle toward the bending direction, a range within which an end of the bending jig 50 can contact the end portion of the protrusion is widened by a gap d. In FIG. 8, the inclination is given as $\alpha=15°$, however, the preformed inclination may not be restricted to the value. Further, since a top end 14B of the end portion is formed as a tapered shape, unsuitable interference with the bending jig 50 can be avoided. Therefore, in the case of pressing the protrusion 14, the pressing can be done under the certain contact between the end of the bending jig 50 and the protrusion 14.

The receiving stand 20 is used for defining the bending position and the shape as a bending die when the protrusion 14 is bent with the bending jig 50 inserted through the press window. The distance between the front end wall 16 and the contact draw-out constraint wall 17 is configured to be equal to or a little larger than the distance between the top end of the crimp contact 13 and the rear end of the protrusion 14. Besides, although the sectional shape of the receiving stand 20 is designed as a rectangle in the embodiment of FIG. 6, the sectional shape may not be restricted to that, but any sectional shape can be adopted as far as a prescribed bending shape of the protrusion 14 may be achieved in combination with the bending jig 50. Further, an edge 20A corresponding to the bending position 14C of the protrusion 14 may be cornered.

When the crimp connector 10 is assembled, the crimp contact 13 is inserted from the backside to the front side into the contact slot 12 of the connector housing 11 to be located at the proper front position by means of butting the top end of the crimp contact 13 against the front end wall 16 of the contact slot 12. Since the protrusion 14 of the crimp contact 13 is standing in a upright position, the protrusion passes along the side of the contact draw-out constraint wall 17 to reach in front of the wall, as shown in FIG. 3.

Figure 6:
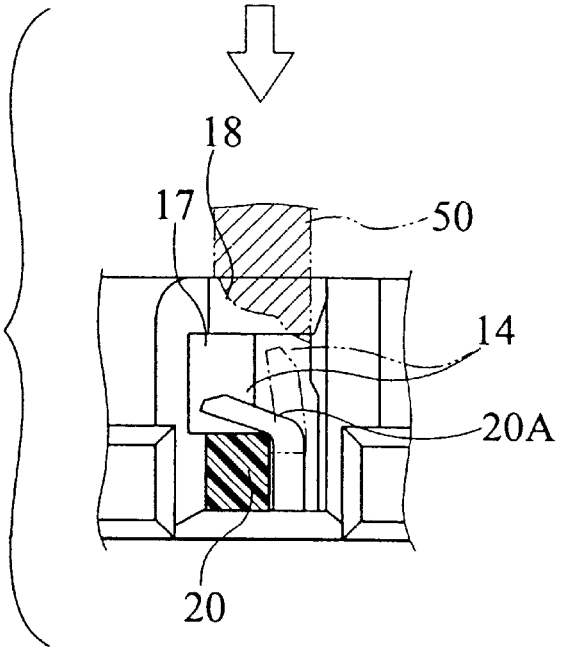
FIG. 6 is a front view showing the relationship between the protrusion and a receiving stand in the crimp connector.
Figure 7:
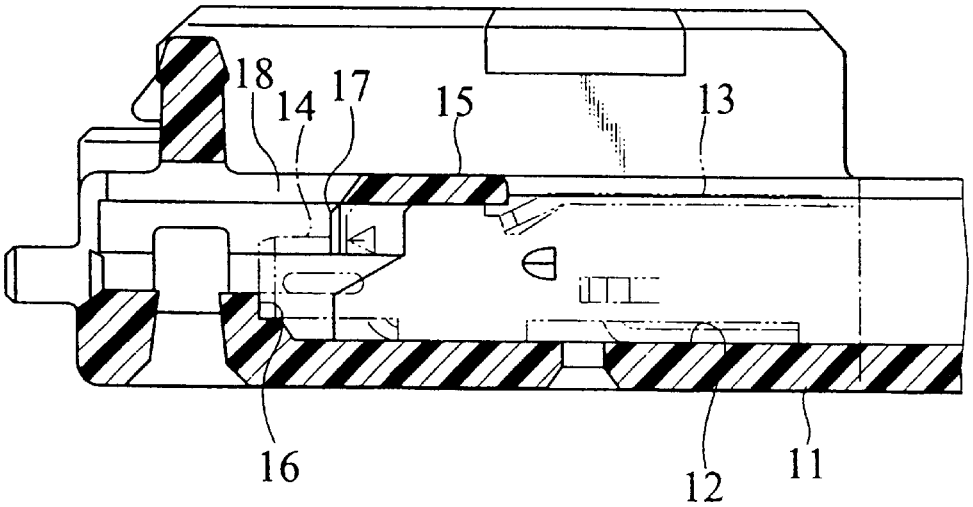
FIG. 7 Is a sectional view showing the relationship between the protrusion and a contact draw-out constraint wall in the crimp connector.

As shown in FIG. 6, after inserting the bending jig 50 through the press window 18 formed on the upper wall 15, the protrusion 14 is then bent by pressing. Since the end portion of the protrusion 14 is inclined a little toward the bending direction at the moment, the protrusion 14 can be pushed to the prescribed direction through certain contact with the end of the bending jig, and therefore the protrusion 14 can be surely bent only in one press operation. Further, since the receiving stand 20 formed in the contact slot 12 acts as a bending die, the protrusion 14 can be bent in a uniform shape at the proper location using the edge of the receiving stand 20 as a supporting point. Moreover, since the receiving stand 20 is formed as an integral part of the connector housing 11, there is no need of an extra receiving stand.

Once the protrusion 14 is bent, the bent protrusion 14 is linked with the contact draw-out constraint wall 17, and the crimp contact 13 is joined to be restrained from the backward draw-out. Therefore, under this situation an electric wire W can be surely crimped onto the crimp blade 19 of the crimp contact 13 using a crimp punch. Namely, since an electric wire is crimp-connected under the condition where the crimp contact is securely joined by bending the protrusion, proper crimp operations of electric wires can be done preventing the mislocation between the crimp punch and the crimp blade, and therefore a crimp failure can surely be avoided.

According to the present invention, by bending the protrusion formed on the crimp contact after having inserted the crimp contact into the contact slot, the crimp contact can be surely fixed at the given position. Therefore, not only contact reliability can be enhanced in the case of being connected with a coupling connector, but also a misoperation can be excluded during crimp-connecting an electric wire with a crimp punch. Moreover, since a receiving stand which is an integral part of a connector housing can be utilized during bending a protrusion, a shape of the bent protrusion may be uniform, holding force of the crimp contact may be increased, and any chance of a fracture by unusual deformation can be eliminated. Since the receiving stand is formed in the contact slot, there is no need of an extra receiving stand for bending operation.

Further, according to the present invention, since the end portion of the protrusion before bending is inclined, the protrusion can be bent in a uniform shape without any improper interference with the bending jig in only one press operation, and stabilization of quality can also be attained eliminating dispersion of a bent shape.

What is claimed is:

1. A crimp connector wherein a crimp contact is inserted into a contact slot of a connector housing from the backside to the front side thereof comprising:

a contact draw-out constraint wall facing forward, the contact draw-out constraint wall being formed in the contact slot of said connector housing;

a protrusion formed on the crimp contact, the protrusion being linked with said draw-out constraint wall to restrain the crimp contact from backward draw-out, said protrusion being capable of being bent with a bending jig; and a receiving stand formed within a space in front of said contact draw-out constraint wall, said receiving stand defining a bending position as a bending die when said protrusion is bent with said bending jig.

2. A crimp connector of claim 1 wherein an end portion of said protrusion is inclined toward a bending direction before bending operation.

3. A crimp connector of claim 1 wherein a top end of the end portion of said protrusion is formed as a tapered shape.

4. A crimp connector of claim 1 wherein an electric wire to be crimp-connected to said crimp connector is crimp-connected under the condition where the crimp contact is being restrained from the draw-out by bending said protrusion.

* * * * *